US010120302B2

(12) United States Patent
Pingel et al.

(10) Patent No.: US 10,120,302 B2
(45) Date of Patent: Nov. 6, 2018

(54) SEALING INK DEVELOPER UNITS WITH MULTIPLE COMPLIANT SEALING MEMBERS

(71) Applicant: Hewlett-Packard Indigo B.V., Amstelveen (NL)

(72) Inventors: James Pingel, San Diego, CA (US); Christopher S Tanner, San Diego, CA (US); Evgeny Korol, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/114,809

(22) PCT Filed: Jan. 31, 2014

(86) PCT No.: PCT/US2014/014291

§ 371 (c)(1),
(2) Date: Jul. 27, 2016

(87) PCT Pub. No.: WO2015/116206

PCT Pub. Date: Aug. 6, 2015

(65) Prior Publication Data

US 2016/0349668 A1 Dec. 1, 2016

(51) Int. Cl.
*G03G 15/08* (2006.01)
*G03G 15/10* (2006.01)

(52) U.S. Cl.
CPC ..... *G03G 15/0898* (2013.01); *G03G 15/0812* (2013.01); *G03G 15/0881* (2013.01); *G03G 15/10* (2013.01)

(58) Field of Classification Search
CPC ..... G03G 15/0898
(Continued)

(56) References Cited

U.S. PATENT DOCUMENTS 7,076,185 B2 7/2006 Okamoto
7,536,131 B2 5/2009 Kawai
(Continued)

FOREIGN PATENT DOCUMENTS

JP S5749972 3/1982

OTHER PUBLICATIONS

Gallivan, et al., "Environmental Considerations Relevant to Electrophotographic Toner Cartridges", NIP & Digital Fabrication Conference, 1999 International Conference on Digital Printing Technologies. pp. 374-757., pp. 455-458(4) Available online at: http://www.ingentaconnect.com/content/ist/nipdf/1999/00001999/00000002/art00021.

*Primary Examiner* — Quana M Grainger
(74) *Attorney, Agent, or Firm* — Fabian VanCott

(57) ABSTRACT

An example device, for sealing an ink developer unit in accordance with aspects of the present disclosure includes a rigid plate. The device also includes a first compliant sealing member disposed on a first side of the rigid plate to form a seal between the number of rollers of the ink developer unit and the rigid plate. The device also includes a second compliant sealing member disposed on a second side of the rigid plate to form a seal between the rigid plate and an end cap of the ink developer unit. The first compliant sealing member, the second compliant sealing member, or combinations thereof include a developer roller arm aligned with an interior portion of a developer roller face and to allow ink to contact the developer roller face.

20 Claims, 9 Drawing Sheets

(58) Field of Classification Search
USPC ..... 399/103
See application file for complete search history.

(56) References Cited

U.S. PATENT DOCUMENTS

| | | | | |
|---|---|---|---|---|
| 7,627,265 | B2 | 12/2009 | Gayne et al. | |
| 8,620,177 | B2 | 12/2013 | Carot | |
| 2007/0134020 | A1 | 6/2007 | Lee et al. | |
| 2009/0274481 | A1 | 11/2009 | Xu et al. | |
| 2012/0027468 | A1 | 2/2012 | Nelson et al. | |
| 2012/0177401 | A1 | 7/2012 | Nishida | |
| 2013/0149002 | A1 | 6/2013 | Karp et al. | |
| 2014/0029971 | A1 | 1/2014 | Pingel et al. | |
| 2014/0056610 | A1* | 2/2014 | Kitta ..... | G03G 15/0898 399/103 |

* cited by examiner

SEALING INK DEVELOPER UNITS WITH MULTIPLE COMPLIANT SEALING MEMBERS

BACKGROUND

Ink developer units are used to supply a film of ink to a photoelectric imaging plate (PIP) drum which then deposits the ink on a substrate such as paper. The ink supplied by the ink developer unit is a pressurized ink and the ink developer unit may be sealed to prevent in leakage.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

Figure 1:
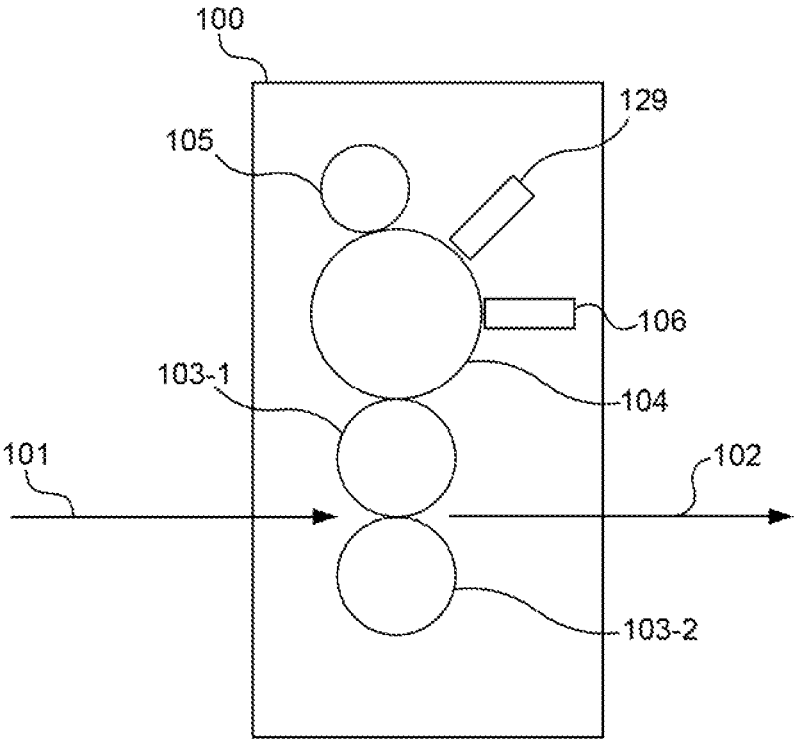
FIG. 1 is a block diagram of an ink printing system according to one example of the principles described herein.

DETAILED DESCRIPTION ink developer units may be used to supply a film of ink to a printing system which then deposits the ink on a substrate such as paper. One example of an ink printing system is a liquid electrophotography printer (LEP). In liquid electrophotography, a photo conductive drum may be charged and selectively exposed with a laser to form a charge pattern that corresponds to an image to be printed on the substrate. The photo conductive drum, or PIP, may then be contacted with a number of ink developers such as binary ink developers (BID) that selectively transfer a liquid ink pattern to the charge pattern to form an ink pattern on the PIP drum corresponding to an image to be printed. The ink patterns may then be transferred from the PIP drum to an intermediate drum. The intermediate drum may then transfer the liquid ink pattern to the substrate.

The ink developer unit may be a replaceable unit that receives ink from an ink reservoir and transfers the ink to the PIP. The ink developer unit may include a developer roller that imparts a thin film of ink to a charged surface of the PIP. Ink that is not transferred to the PIP may be cleaned from the developer roller and recycled by various components of the ink developer unit. While these ink developer units may be beneficial in providing an efficient mechanism to deliver ink to a PIP drum, certain characteristics of the ink developer unit may complicate its use.

For example, the ink developer unit may be an expensive component of the ink printing system. Additionally, the ink developer unit may have a reduced life and its replacement may contribute to the cost of operating an LEP printer. Factors that may contribute to the reduced life of an ink developer unit include 1) a reduced life of the developer roller, 2) sludge buildup inside the ink developer unit and 3) wear of internal components of the ink developer unit. Still further, because an ink developer unit uses pressurized ink, the unit is sealed to prevent ink leakage. Such a seal is difficult to maintain due to the various rollers within the ink developer unit. Difficulty in generating a seal is further exacerbated as some ink developer units include removable and replaceable rollers.

Accordingly, the present disclosure describes devices and systems for sealing ink within an ink developer unit. More specifically, the systems and devices disclosed herein provide an interference seal between a number of compliant sealing members and a number of rollers of the ink developer unit to prevent pressurized ink from leaking from the ink developer unit. The geometry of the compliant sealing members may allow ink to come into contact with the side of the developer roller. Doing so may allow the ink, which may be maintained at a constant temperature, to cool the side of the developer roller. Cooling the side of the developer roller may be beneficial in that it reduces the sealing temperatures at various locations of the ink developer unit. The reduced sealing temperature may reduce the buildup of sludge within the ink developer unit and may therefore increase the lifetime of the ink developer unit.

The present disclosure describes an example device for sealing an ink developer unit. The device may include a rigid plate. The device may also include a first compliant sealing member disposed on a first side of the rigid plate to form a seal between a number of rollers of the ink developer unit and the rigid plate. The device may also include a second compliant sealing member disposed on a second side of the rigid plate to form a seal between the rigid plate and an end cap of the ink developer unit. The first compliant sealing member, the second compliant sealing member, or combinations thereof may include developer roller arms aligned with an interior portion of a side of the developer roller and may allow ink to contact the side of the developer roller.

The present disclosure describes an example ink developer unit. The ink developer unit may include a housing unit and a number of rollers rotatably coupled to the housing unit. The ink developer unit may also include an ink neck to deliver ink from a reservoir to a developer roller. An end cap may be removably coupled to the housing unit to rotatably support the number of rollers. The ink developer unit may include a sealing device disposed within the housing unit. The sealing device may include a rigid plate to hold a number of compliant sealing members and a number of compliant sealing members to form a seal between the number of rollers and the end cap. The number of compliant sealing members may allow ink to contact a side of the developer roller.

The present disclosure describes another example ink developer unit. The ink developer unit may include a housing unit and an end cap removably coupled to the housing unit. The ink developer unit may also include an electrode. The ink developer unit may also include a sealing device disposed within the housing unit. The sealing device may include a rigid plate and a first compliant sealing member disposed on the rigid plate. The first compliant sealing member may include a developer roller arm aligned with an interior portion of a side of the developer roller and a cleaner roller arm. The electrode, end cap, developer roller arm and the cleaner roller arm may form a pocket to allow ink to contact the side of the developer roller.

The systems and devices described herein may be beneficial in that they 1) effectively seal pressurized ink between a number of rollers and an end cap of an ink developer unit, 2) maintain an effective sealing performance after replacement of a developer roller, 3) reduce leaks and sludge buildup, especially at a squeegee-developer roller interface, 4) cool a sealing surface via a constant flow of temperature-controlled ink, regardless of the ink developer unit operating orientation, 5) prevent fusing and drying of ink on the sealing surface, and 6) maintain the ink developer unit in place during use.

As used in the present specification and in the appended claims, the term "a number of" or similar language may include any positive number including 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

FIG. 1 is a block diagram of an in printing system (100) according to one example of the principles described herein. As described above, the ink printing system (100) may be used to deposit ink on a substrate such as paper. The ink may be deposited in a pattern such as text or graphics. The system (100) may receive a substrate as indicated by the arrow (101). The system (100) may then deposit ink in a pattern on to the substrate. The substrate may then exit the printing system (100) with the corresponding ink printed thereon, as indicated by the arrow (102).

More specifically, the system (100) may include a number of application rollers (103) to transfer a patterned ink to the substrate. For example, a top application roller (103-1) may include ink in a pattern that is to be transferred to the substrate. The substrate may be pinched between the top application roller (103-1) and a bottom application roller (103-2) to ensure an even and thorough distribution of ink on the substrate. The top application roller (103-1) may receive the patterned ink from a photoelectric imaging plate (PIP) drum (104) on which the pattern may be formed. The outer surface of the PIP drum (104) may be charged uniformly by a charging roller (105). A writing head (129) may then selectively discharge portions of the PIP drum (104) to create a pattern that corresponds to the image or text to be printed on the substrate allowing ink to transfer to these areas from, a developer roller of the ink developer unit (106).

The ink developer unit (106) may apply liquid ink to the charged surfaces of the PIP drum (104) to form an image that is to be transferred to the top application roller (103-1). As will be described in more detail below, the ink developer unit (106) may include a sealing device to prevent ink leaking from the ink developer unit (106). In some examples, the ink developer unit (106) may be removably coupled to the PIP drum (104).

Figure 2:
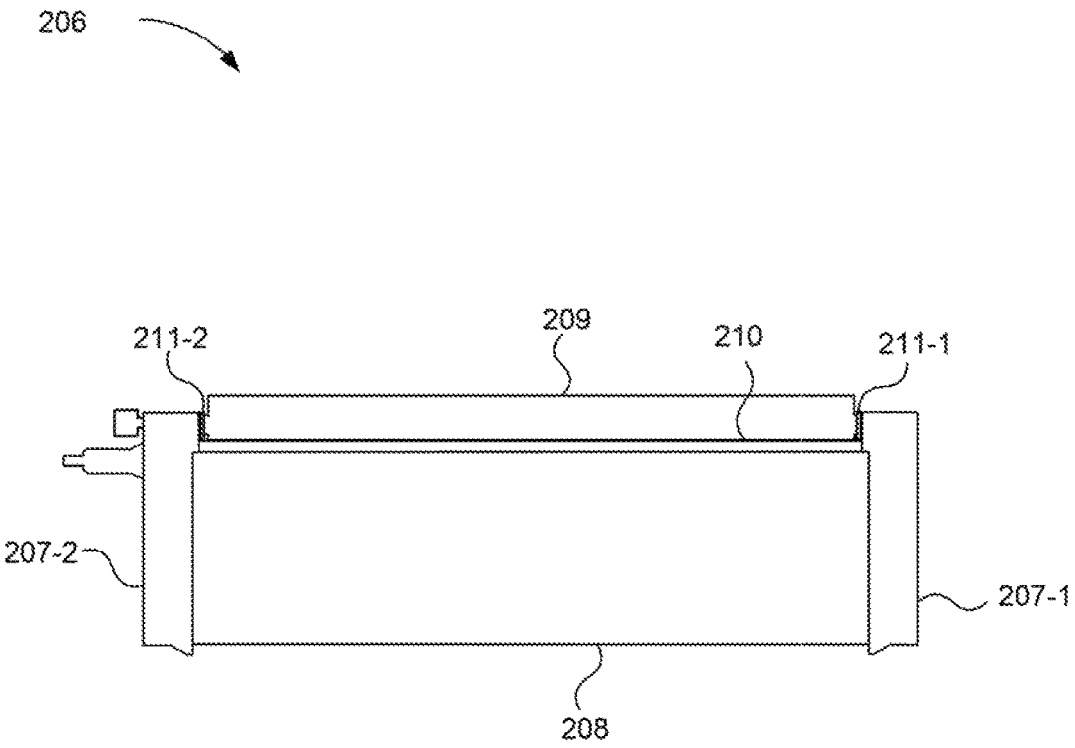
FIG. 2 is a side view of an ink developer unit according to one example of the principles described herein.

FIG. 2 is a side view of an ink developer unit (206) according to one example of the principles described herein. The ink developer unit (206) may include a number of end caps (207-1, 207-2) and a housing unit (208) to house and support a number of rollers. For example, the ink developer unit (206) may include a first end cap (207-1) on a first end of the ink developer unit (206) and a second end cap (207-2) on a second end of the ink developer unit (206). For simplicity, the end caps (207) may be referred to collectively. The number of rollers may include a developer roller (209). The developer roller (209) may transfer an ink film to a PIP drum (FIG. 1, 104) of an ink printing system (FIG. 1, 100). For example, the developer roller (209) may receive charged and pressurized ink from an ink reservoir of the ink developer unit (206). The charged ink on the developer roller (209) may be attracted and transferred to the charged portions of the PIP drum (FIG. 1, 104) that correspond to an image to be printed. The ink may be transferred to the substrate via the application rollers (FIG. 1, 103). The ink on the developer roller (209) may pass by a squeegee roller (210), which the squeegee roller (210) regulates the thickness of the ink film on the developer roller (209). Via the squeegee roller (210) an ink film of uniform thickness may be applied to the PIP drum (FIG. 1, 104).

The ink developer unit (206) may also include a number of sealing devices (211-1, 211-2) on either end of the ink developer unit (206). For example, a first sealing device (211-1) may be used on a first end of the ink developer unit (206) and a second sealing device (211-2) may be used on a second end of the ink developer unit (206). For simplicity, the first sealing device (211-1) and the second sealing device (211-2) may be referred to collectively as a sealing device (211). The sealing devices (211) may prevent ink from leaking out of the faces of the ink developer unit (206). More specifically, a number of sealing devices (211) placed on either side of the ink developer unit (206) and within each end cap (207) may form a seal between a number of rollers, including the developer roller (209) and the squeegee roller (210). The sealing devices (211) may be designed to be positioned on either side of the developer roller (209) and to seal on either end of the developer roller (209). The end caps (207) may also rotatably support a number of rollers including the developer roller (209), the squeegee roller (210) and other rollers.

Figure 3:
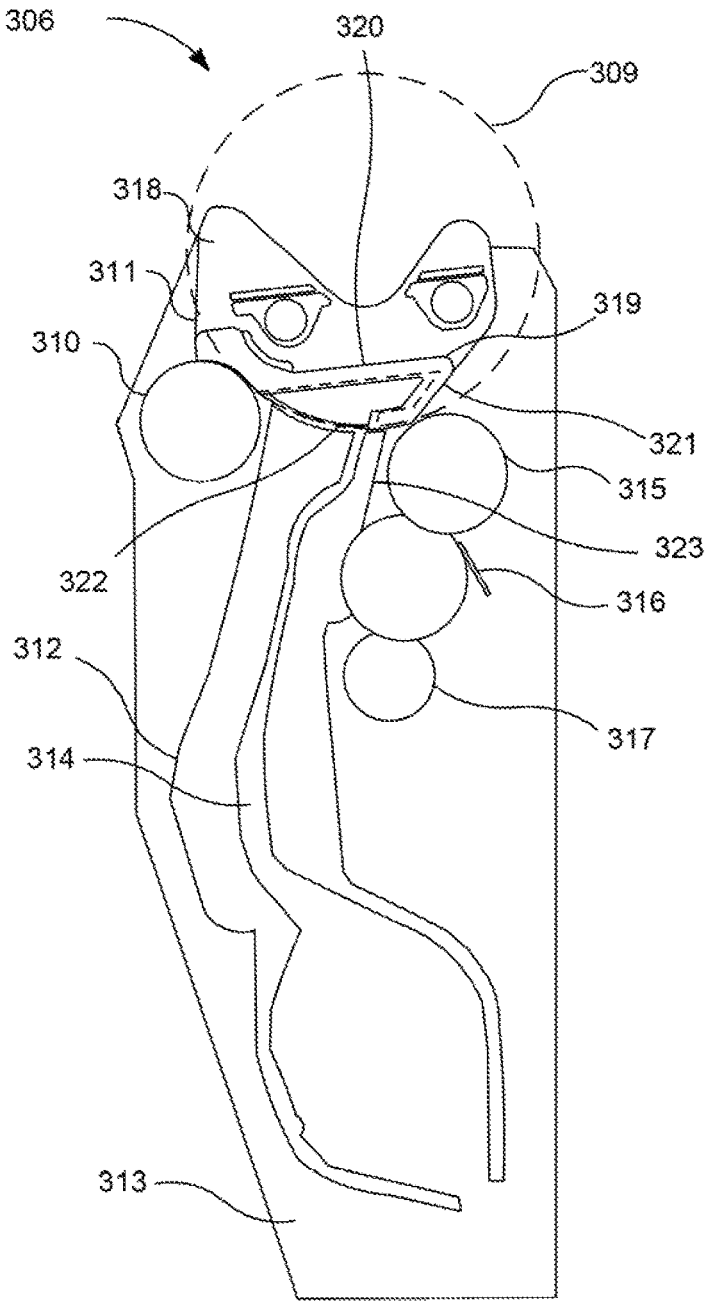
FIG. 3 is a cross sectional view of an ink developer unit according to one example of the principles described herein.

FIG. 3 is a cross sectional view of an ink developer unit (306) according to one example of the principles described herein. The ink developer unit (306) may include a main electrode (312) that drives charged ink to a developer roller (309) through an electrical potential. In FIG. 3, the developer roller (309) body may extend out of the page. The ink may reside in an ink reservoir (313) of the ink developer unit (306). More specifically, the ink may enter an electrode neck (314) to the developer roller (309). Excess ink may flow down into the ink reservoir (313) where it may remix with bulk ink. It is via this bulk ink in the ink reservoir (313) that the temperature of the ink may be controlled. As described above, the oppositely charged ink may be attracted to, and be transferred to, the developer roller (309). The squeegee roller (310) may regulate the ink film thickness on the developer roller (309). The developer roller (309) may then transfer the ink film to the PIP drum (FIG. 1, 104). Excess ink that is not transferred to the PIP drum (FIG. 1, 104) may be cleaned off the developer roller (309) by the clearer roller (315). A wiper blade (316) may then clean off the cleaner roller (315). A sponge roller (317) may then clean the wiper blade (316). The cleaner roller (315), wiper blade (316), and the sponge roller (317) allow the ink to be recycled and also reduce the buildup of sludge within the ink developer unit (306). As indicated in FIG. 3, additional components within the ink developer unit (306) may be used to transfer ink to the developer roller (309), clean the ink developer unit (306), or otherwise aide in the operation and function of the ink developer unit (306).

The ink developer unit (306) may also include a sealing device to seal ink within the ink developer unit (306). More specifically, the sealing device (311) may seal ink between a number of rollers and an end cap (e.g., FIG. 2, 207) within the ink developer unit (306). For example, the sealing device (311) may seal ink between the developer roller (309), the squeegee roller (310), the cleaner roller (315) and the end cap (FIG. 2, 207) of the ink developer unit (306). The sealing device (311) may include a rigid plate (318) to position a number of compliant sealing members (319). For example, the rigid plate (318) may include a first compliant sealing member (319) disposed on a first side of the rigid plate (318) and a second compliant sealing member (not shown) disposed on a second side of the rigid plate (318). The compliant sealing members (318) form an interface fit between the rigid plate (319) and other components. For example, the first compliant sealing member (319) may form an interface fit between the developer roller (309), the squeegee roller (310), the cleaner roller (315) and the rigid plate (318). Similarly, the second compliant sealing member (not shown) may form an interface fit between the rigid plate (318) and the end cap (FIG. 2, 207). In other words, the sealing device (311) may be compressed between the developer roller (309) and the end cap (FIG. 2, 207).

As will be described in connection with FIGS. 5 and 6, the first compliant sealing member (319) and the second compliant sealing member (not shown) may be of a similar geometry. Specifically, the compliant sealing members (319) may include a developer roller arm (320) and a cleaner roller arm (321). The developer roller arm (320) may align with the developer roller (309) at an interior point of the side of the developer roller (309). In other words, the developer roller arm (320) may not align with the circumference of the side of the developer roller (309). The positioning of the developer roller arm (320) at a point interior to the developer roller (309) circumference may be beneficial in that it, along with the cleaner roller arm (321) and the main electrode (312), form a pocket (322) where the ink may contact a side of the developer roller (309). This may allow ink delivered from the electrode neck (314) to cool the side of the developer roller (309).

For example, as the developer roller (309) rotates during operation, the side of the developer roller (309) may rub against the first compliant sealing member (319), Doing so may cause friction, which may cause the side of the developer roller (309) to heat up. This increased temperature of the side of the developer roller (309) may lead to the formation of sludge within the ink developer unit (306), which sludge may shorten the effective life of the ink developer unit (306). Accordingly, positioning the developer roller arm (320) such that temperature-controlled ink may cool the side of the developer roller (309) may increase the life of the ink developer unit (306). A cooler developer roller (309) side may reduce the likelihood of sludge buildup, and thus increase the effective life of the ink developer unit (306). In other words, the geometry of the compliant sealing member (319) may allow components within the ink developer unit (306) to be cooled during operation by the ink that is in the pocket (322).

Moreover, a developer roller arm (320) that is interior to the developer roller (309) side circumference may be beneficial in that it positions the developer roller arm (320) in a position relative to the developer roller (309) that experiences less linear velocity. For example, as the developer roller (309) rotates during operation, an interface between the developer roller (309) and the first compliant sealing member (319) generates friction. This friction generates heat. As described above, the heat may contribute to sludge formation. Because there is less linear velocity nearer the center of the developer roller (309), a lower rate of work is exhibited, and accordingly, the temperature of the developer roller (309) may be reduced due to less heat generation. In other words, the reduced linear velocity at an interior portion of the side of the developer roller (309) may reduce the rate of work which also may reduce the sealing temperature and likelihood of sludge buildup in the ink developer unit (306).

In some examples, the cleaner roller arm (321) may be positioned tangentially to the cleaner roller (315). Doing so may direct excess ink away from the developer roller (309) which may reduce the buildup of ink sludge around the developer roller (309). For example, the rotation of the developer roller (309) and the cleaner roller (315) relative to one another may pull accumulated excess ink back into the cleaning system (i.e., the cleaner roller (315), the wiper blade (316), and the sponge roller (317), among other components) instead of allowing it to accumulate on the cleaner roller arm (321). The cleaner roller arm (321) may extend from the tangential contact with the cleaner roller (316) to interface with a back electrode (323). The interface with the back electrode (323) may prevent excess ink from leaking over the cleaner roller (315).

Figure 4:
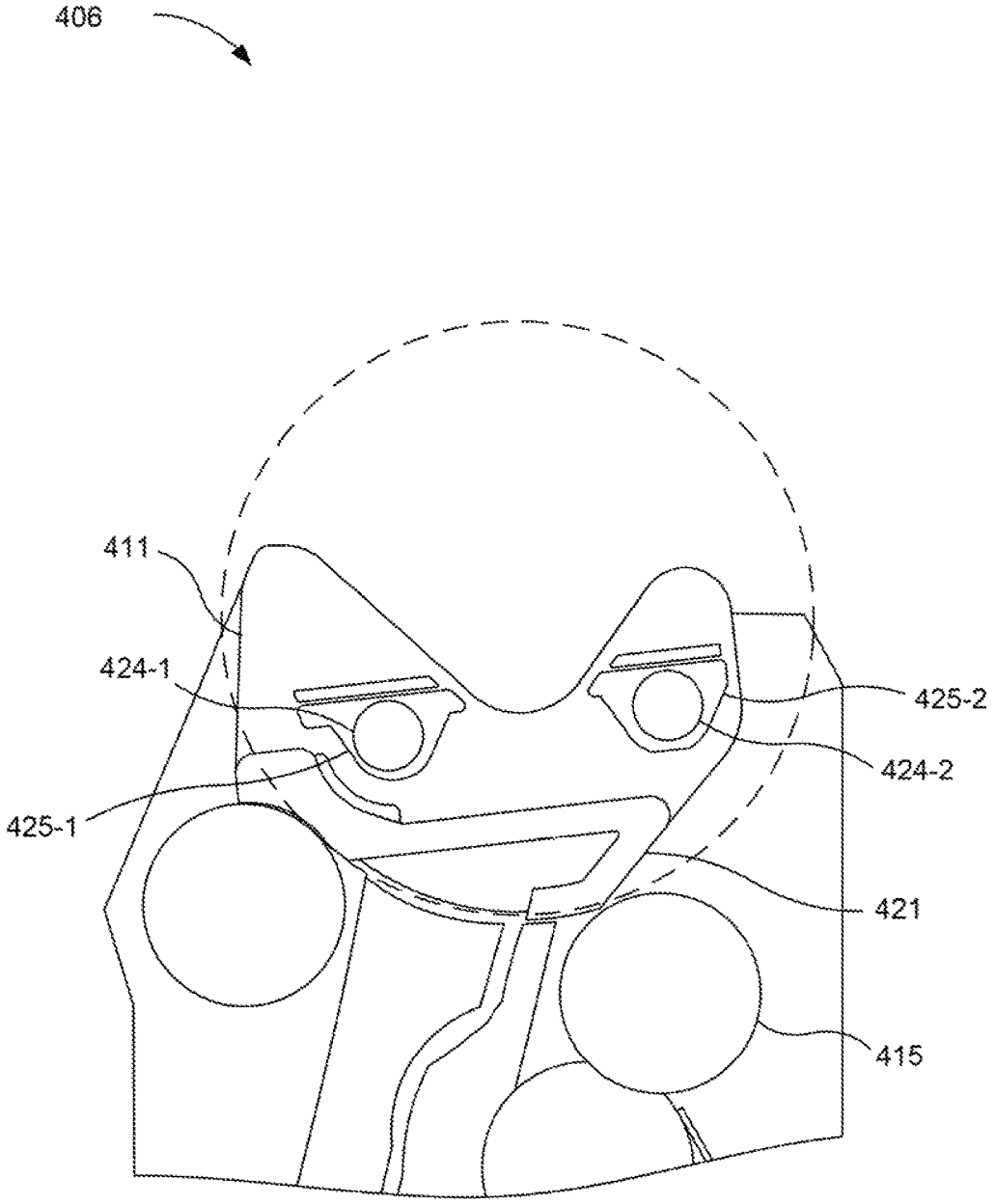
FIG. 4 is a cross sectional view of an ink developer unit according to one example of the principles described herein.

FIG. 4 is a cross sectional view of an ink developer unit (406 according to one example of the principles described herein. In some examples, the sealing device (411) may be removably coupled to the it developer unit (406). In other words, the sealing device (411) may be detached from the ink developer unit (406) to perform routine maintenance on the sealing device (411) or other components of the ink developer unit (406), to replace a component of the ink developer unit (406), among other operations. The sealing device (411) may include an alignment mechanism to align the sealing device (411) with a number of rollers within the ink developer unit (406). For example, the ink developer unit (406) may include a number of pins (424-1, 424-2). For simplicity a number of pins (424-1, 424-2) may be referred to as pins (424). The alignment mechanism may include a number of slots (425-1, 425-2) that correspond to the number of pins (424). For simplicity a number of slots (425-1, 425-2) may be referred to as slots (425). During alignment, the sealing device (411) may be aligned with the ink developer unit (406) by aligning the slots (425) with the number of pins (424).

As described above in connection with FIG. 2, the sealing device (411) may be designed to be implemented on either side of a developer roller (409). Accordingly, the alignment mechanism may be designed to align the sealing device (411) with the ink developer roller (406) regardless of which side of the ink developer unit (406) it is to be used. Allowing the sealing device (411) to be implemented on either side of an ink developer unit (406) may be beneficial in that it alleviates the need to have side-specific parts for the ink developer unit (406).

The alignment mechanism may also be designed to properly orient the sealing device (411) with other components within the ink developer unit (406). For example the alignment mechanism may orient the sealing device (411) such that the cleaner roller arm (421) may align with the cleaner roller (415) as described above, rather than another orientation.

Implementing the alignment mechanism to ensure proper orientation of the sealing device (411) may be beneficial in that it simplifies the implementation of the sealing device (411) as positioning the sealing device (411) to generate a seal is, simplified. In some examples, in addition to ensuring proper alignment of the sealing device (411) relative to the ink developer unit (406), the slots (425) and pins (424) may ensure the sealing device (411) is not improperly aligned relative to the ink developer unit (406). In other words, the slots (425) and pins (424) may prevent the attachment of the sealing device (411) unless properly aligned with the ink developer unit (406). As will be described in connection with FIG. 5, the pins (424) and slots (425) may also be used as a mechanism to secure the sealing device (411) to the ink developer unit (406).

Figure 5:
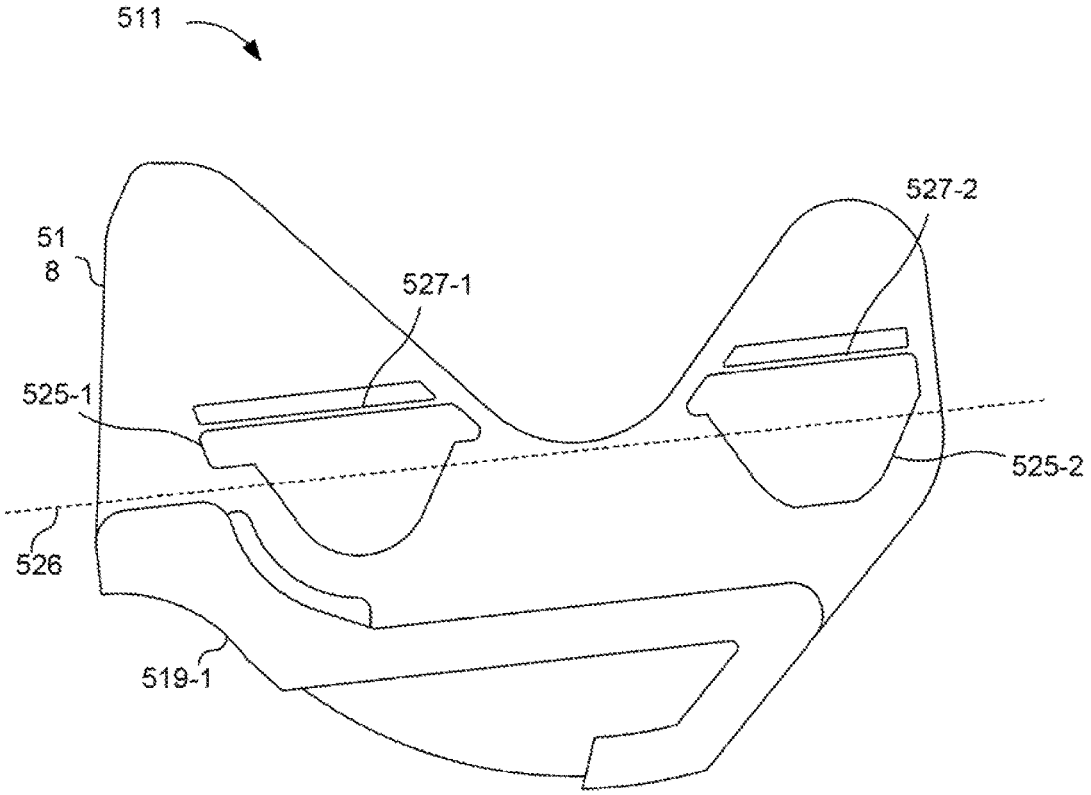
FIG. 5 is a side view of a device for sealing an ink developer unit according to one example of the principles described herein.

FIG. 5 is a side view of a device (511) for sealing an ink developer unit (e.g., FIG. 1, 106) according to one example of the principles described herein. As described above, the sealing device (511) may include a rigid plate (518) and a number of compliant sealing members (519). More specifically, a first compliant sealing member (519-1) may be positioned on a first side of the rigid plate (518) and may form a seal between the rigid plate (518) and a number of rollers of the ink developer unit (FIG. 1, 106). Similarly, a second compliant sealing member (not shown) may be positioned on a second side of the rigid plate (518) and may form a seal between the rigid plate (518) and an end cap (e.g., FIG. 2, 207) of the ink developer unit (e.g., FIG. 1, 106), in some examples, the rigid plate (518) may be made of a plastic material. The first compliant sealing member (519-1), the second compliant sealing member (not shown), or combinations thereof may be made of closed cell foam. Using closed cell foam for the compliant sealing members (519) may be beneficial in that the closed cell foam may create a sealing interface with the various material surfaces of the ink developer unit (FIG. 1, 108). For example, the developer roller (e.g., FIG. 2, 209) may include a polyurethane surface that is soft and sticky. The closed foam cell compliant sealing members (51 may allow a seal to be formed with such a surface material.

As described above, the sealing device (511) may include a number of slots (525-1, 525-2) to ensure proper alignment of the sealing device (511) with other components of the ink developer unit (e.g., FIG. 1, 106). In some examples, the alignment mechanism may allow the sealing device (511) to pivot relative to the ink developer unit (e.g., FIG. 1, 106). More specifically, the slots (525) may allow the sealing device (511) to pivot about an axis (526) common to the slots (525). In other words, the sealing device (511) may pivot in a plane perpendicular to the rigid plate (518).

The slots (525) and pins (e.g., FIG. 4, 424) may also function as a mechanism to secure the sealing device (511) to an ink developer unit (e.g., FIG. 1, 106). For example, the pins (e.g., FIG. 4, 424) may include a tip that is wider than a body of the pins (e.g., FIG. 4, 424). The sealing device (511) may include a number of flexible beams (527-1, 527-2) that flex around the tip of the pins (e.g., FIG. 2, 242) and snap into place to secure the sealing device (511) to the ink developer unit (e.g., FIG. 1, 106).

Figure 6:
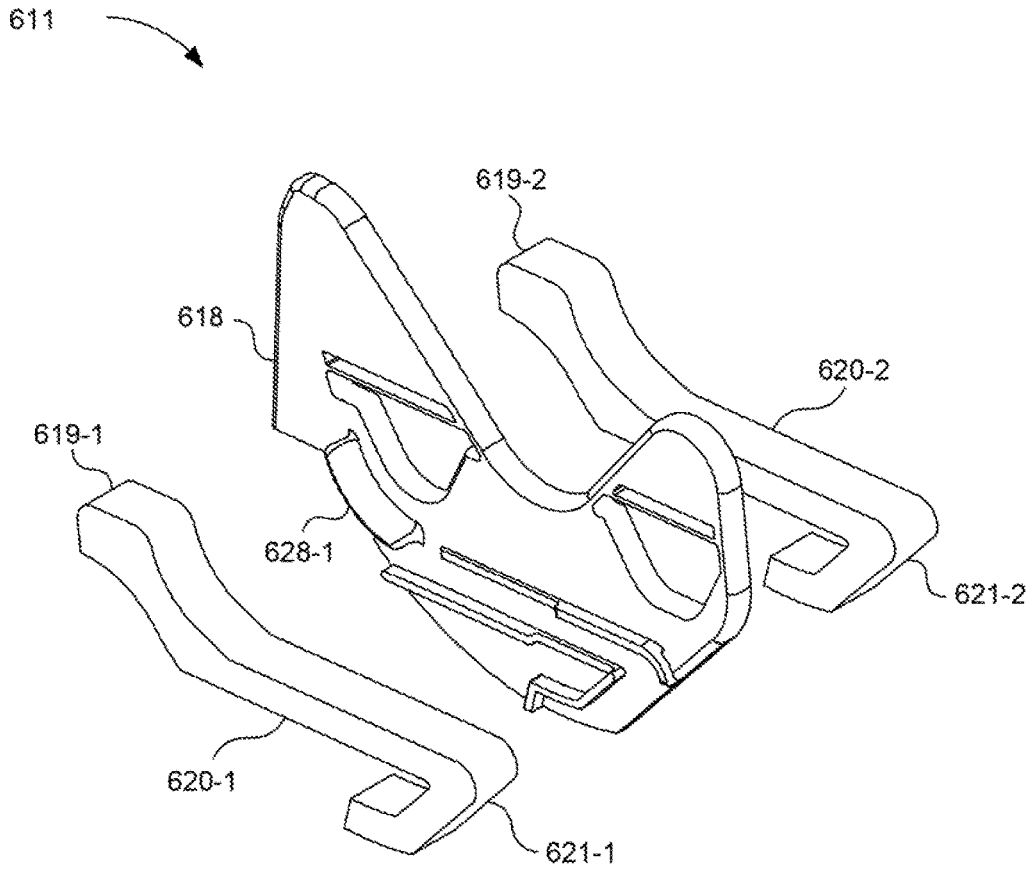
FIG. 6 is an exploded isometric view of a device for sealing an ink developer unit according to one example of the principles described herein.

FIG. 6 is an exploded isometric view of a device (611) for sealing an ink developer unit (e.g., FIG. 1, 106) according to one example of the principles described herein. As described above, the sealing device (611) may include a rigid plate (618) and a number of compliant sealing members (619). Specifically, the rigid plate (618) may include a first compliant sealing member (619-1) on a first side and may include a second compliant sealing member (619-2) on a second side. The rigid plate (618) may be coupled to the first compliant sealing member (619-1) and the second compliant sealing member (619-2) via an adhesive.

As described above, the compliant sealing members (619) may include a developer roller arm (620) and a cleaner roller arm (621). For example, the first compliant sealing member (619-1) may include a first developer roller arm (620-1) and a first cleaner roller arm (621-1) and a second compliant sealing member (619-2) may include a second developer roller arm (620-2) and a second cleaner roller arm (621-2). The characteristics of the ink developer unit (FIG. 1, 106) may benefit from compliant sealing members (619). For example, the squeegee roller (e.g., FIG. 2, 210) and the cleaner roller (e.g., FIG. 3, 315) may be finished metal with a low coefficient of friction. Accordingly, a compressed closed cell foam compliant sealing member (619) may not generate a high temperature. However, the side of the developer roller (e.g., FIG. 2, 209) may be a soft polyurethane which may have a high coefficient of friction and may result in high sludge-producing temperatures. Accordingly, the compliant sealing members (619) may be of a thickness such that an interference is generated between the compliant sealing members (619) and a developer roller (e.g., FIG. 2, 209) while maintaining sufficient compressibility so as to not result in an increase in friction and corresponding sealing temperature. Accordingly, multiple compliant sealing members (619) with such a thickness may be beneficial by allowing an interface fit, while allowing sealing temperatures to remain low, thus preventing dried and fused ink from accumulating on the ink developer unit (e.g., FIG. 1, 106). Moreover the flexibility of the compliant sealing members (619) may allow for variation in developer roller (e.g., FIG. 2, 209) size and placement within the ink developer unit (FIG. 1, 106).

In some examples, the rigid plate (618) may include a protrusion (628) on either side to compress the compliant sealing members (619). For example a first protrusion (628-1) may compress the first compliant sealing member (619-1) and a second protrusion (not shown) on the opposite side of the rigid plate (618) may compress the second compliant sealing member (619-2). More specifically, the protrusion (628) may compress the compliant sealing members (619) between the rigid plate (618) and a squeegee roller (e.g., FIG. 2, 210). Compressing the compliant sealing members (618) in this fashion may be beneficial in that it creates a greater seal with the squeegee roller (e.g., FIG. 2, 210) thus ensuring a cleaner ink development unit (e.g., FIG. 1, 106).

As described above, the sealing device (611) as described herein may be beneficial in that it may be used on either side of an ink developer unit (FIG. 1, 106). For example, in a first orientation, the second compliant sealing member (**619*b*) may form a seal between the end, cap (e.g., FIG. 2, 207) and the rigid plate (618) while the first compliant sealing member (619*a*) may form a seal between a number of rollers and the rigid plate (618). In another orientation, on the opposite side of the ink developer unit (e.g., FIG. 1, 106) for example, the second compliant sealing member (619) may form a seal between the rigid plate (618) and a number of rollers while the first compliant sealing member (619*a*) may form a seal between the rigid plate (618) and the end cap (e.g., FIG. 2, 207**).

Figure 7:
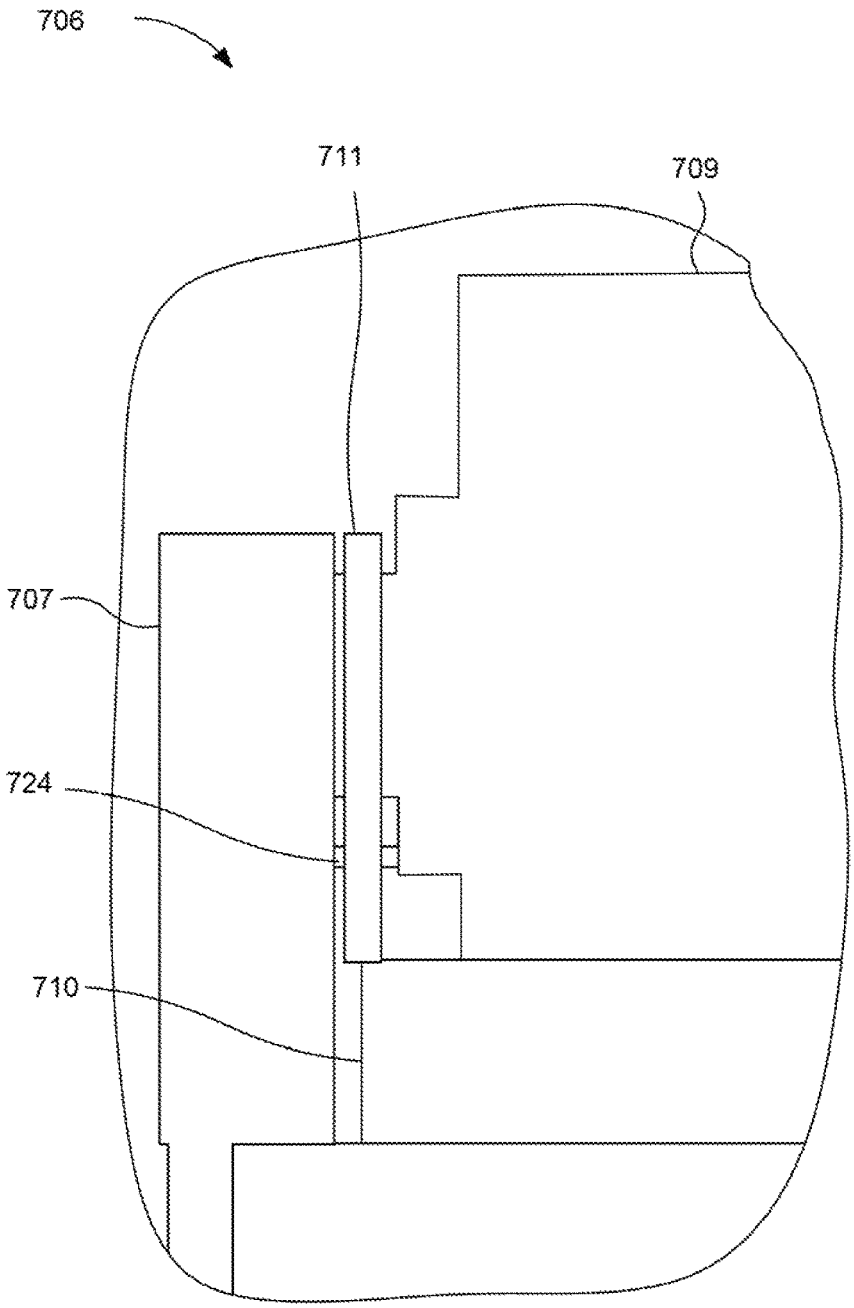
FIG. 7 is a side view of a portion of an ink developer unit according to one example of the principles described herein.

FIG. 7 is a side view of a portion of an ink developer unit (706) according to one example of the principles described herein. As indicated in FIG. 7, the sealing device (711) may be placed between a developer roller (709) and an end cap (707). The sealing device (711) may form a seal between the end cap (707) and a squeegee roller (710). As can be seen in FIG. 7, the slots (e.g., FIG. 5, 525) of the sealing device (711) may engage the pins (724) to align the sealing device (711) within the ink developer unit (706) and may also secure the sealing device (711) to the ink developer unit (706).

Figure 8:
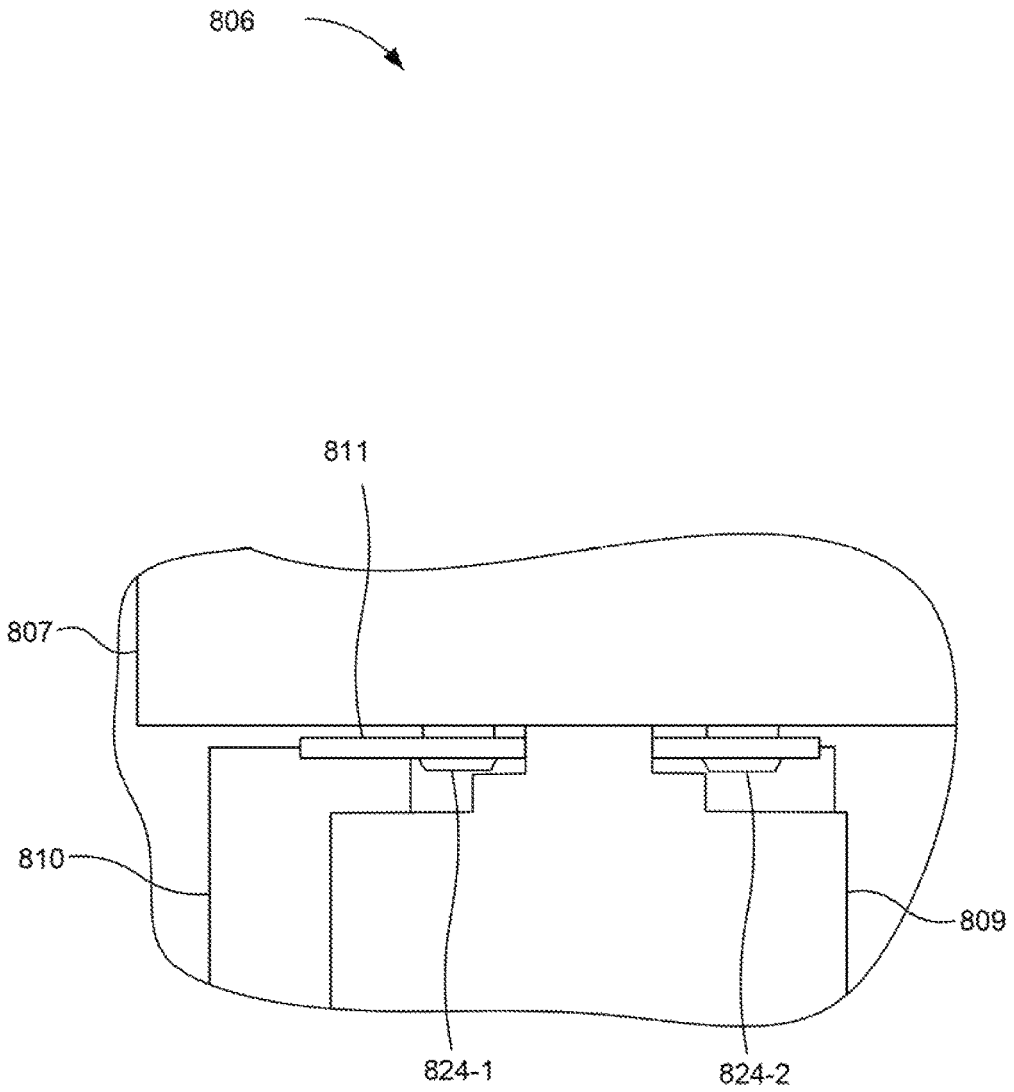
FIG. 8 is a top view of a portion of an ink developer unit to one example of the principles described herein.

FIG. 8 is a top view of a portion of an ink developer unit (806) to one example of the principles described herein. As indicated in FIG. 8, the sealing device (811) is placed between a developer roller (809) and an end cap (807). The sealing device (811) may form a seal between the end cap (807) and a squeegee roller (810). As can be seen in FIG. 8, the slots (e.g., FIG. 5, 525) of the sealing device (811) may engage the pins (824-1, 824-2) to align the sealing device (811) within the ink developer unit (806) and may also secure the sealing device (811) to the ink developer unit (806).

Figure 9:
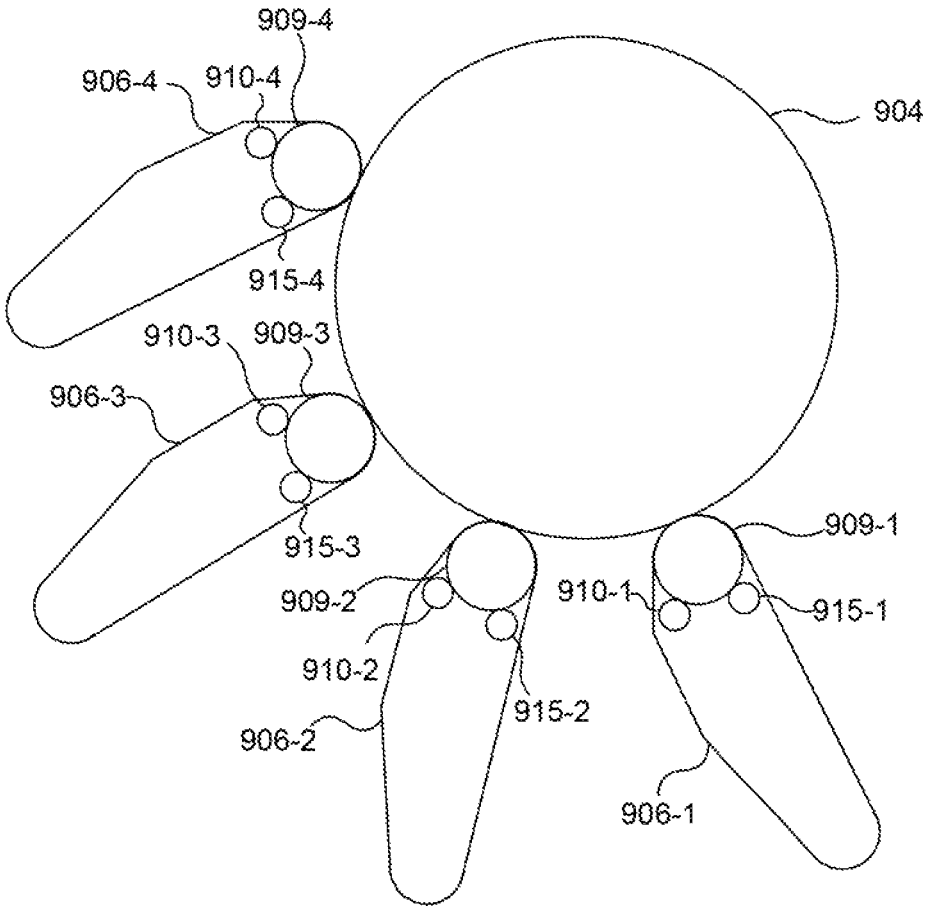
FIG. 9 is a diagram illustrating various ink developer unit positions according to one example of the principles described herein.

FIG. 9 is a diagram illustrating various ink developer unit (906-1, 906-2, 906-3, 906-4) positions according to one example of the principles described herein. An ink developer unit (906-1, 906-2, 906-3, 906-4) may be used in various orientations with respect to a PIP drum (904). For example, an ink developer unit (906-1, 906-2, 906-3, 906-4) may be in a first position, a second position, a third position, or a fourth position. While specific orientations of an ink developer unit (906) are indicated in FIG. 9, an ink developer unit (906) may be in any number of orientations with respect to a PIP drum (904). As indicated, each ink developer unit (906) may include a developer roller (909-1, 909-2, 909-3, 909-4), a squeegee roller (910-1, 910-2, 910-3, 910-4), and a cleaner roller (915-1, 915-2, 915-3, 915-4), among other components described herein.

Ink flow within the ink developer units (906) may vary with the different possible orientations of the ink developer unit (906). For example, ink within the pocket (e.g., FIG. 3, 322) may be relatively evenly split over the main electrode (e.g., FIG. 3, 312) and the back electrode (e.g., FIG. 3, 323) when the ink developer unit (906-1) is in a first position. However, due to the effects of gravity, more ink may flow towards the back electrode (e.g., FIG. 3, 323) when the ink developer unit (906-4) is in a fourth position. When ink flow is reduced to the main electrode (e.g., FIG. 3, 312) such as when the ink developer unit (906-4) is in a position such as the fourth position, the sealing temperature may increase because less cooling ink is in contact with the side of the developer roller (909-4). Accordingly, the ink developer unit (906) as described herein may be beneficial in that a greater amount of ink is allowed to reside in the pocket (e.g., FIG. 3, 322) which may allow the ink to cool the side of the developer roller (909), regardless of the orientation of the ink developer unit (906).

Devices sealing an ink developer unit (e.g., FIG. 1, 106) may have a number of advantages, including: (1) allowing a sealing device (e.g., FIG. 2, 211) to be replaced to ensure effective sealing while accommodating variation in developer roller (e.g., FIG. 2, 209) length and developer roller (e.g., FIG. 2, 209) positioning accuracy; (2); providing a single sealing device (e.g., FIG. 2, 211) that can snap on to either side of an ink developer unit (e.g., FIG. 1, 106); (3) preventing the improper installation of the sealing device (e.g., FIG. 2, 211); (4) providing a seal geometry that contacts the cleaner roller (e.g., FIG. 3, 315) tangentially allowing ink to be wiped from the side of the developer roller (e.g., FIG. 2, 209) to be pulled into the cleaning system by the rotation of the developer roller (e.g., FIG. 2, 209) and the cleaner roller (e.g., FIG. 3, 315) which may reduce sludge buildup at this interface; (5) providing multiple compliant sealing members (e.g., FIG. 3, 319) to allow wider replaceable sealing members (e.g., 3, 319) to contact the developer roller (e.g., FIG. 2, 209), which may result in effective sealing with less sealing pressure; and (6) allowing ink to come into contact with the side of the developer roller (e.g., FIG. 2, 209) to cool the developer roller (e.g., FIG. 2, 209) before the developer roller (e.g., FIG. 2, 209) comes into contact with the squeegee roller (e.g., FIG. 2, 210) to reduce the sealing temperature at this interface and reduce sludge buildup.

The preceding description has been presented to illustrate and describe examples of the principles described. This description is not intended to be exhaustive or to limit these principles to any precise form disclosed. Many modifications and variations are possible in light of the above teaching.

What is claimed is:

1. A device for sealing an ink developer unit, the device comprising:

a rigid plate;

a first compliant sealing member disposed on a first side of the rigid plate to form a seal between a number of rollers of the ink developer unit and the rigid plate; and a second compliant sealing member disposed on a second side of the rigid plate to form a seal between the rigid plate and an end cap of the ink developer unit, wherein at least one of the first compliant sealing member and the second compliant sealing member comprise a developer roller arm aligned with an interior portion of a side of a developer roller and to allow ink to contact the side of the developer roller.

2. The device of claim 1, wherein at least one of the first compliant sealing member and the second compliant sealing member comprise a closed cell foam.

3. The device of claim 1, wherein the ink cools the side of the developer roller.

4. The device of claim 1, further comprising a mechanism to secure the device to the ink developer unit.

5. The device of claim 4, wherein the mechanism includes a number of slots to snap onto a number of pins in an ink developer unit.

6. The device of claim 5, wherein the sealing device pivots about the number of pins in a plane perpendicular to the rigid plate.

7. The device of claim 1, wherein a portion of the first compliant sealing member is compressed between a protrusion on the rigid plate and a squeegee roller.

8. The device of claim 1, wherein the rigid plate is coupled to at least one of the first compliant sealing member and the second compliant sealing member with an adhesive.

9. An ink developer unit, comprising:

a housing unit;

a number of rollers rotatably coupled to the housing unit;

an ink neck to deliver ink from an ink reservoir to a developer roller;

an end cap removably coupled to the housing unit to rotatably support the number of rollers; and a sealing device disposed within the housing unit, the sealing device comprising:

a rigid plate to hold a number of compliant sealing members; and a number of compliant sealing members to form a seal between the number of rollers and the end cap, wherein the number of compliant sealing members allow ink to contact a side of the developer roller.

10. The ink developer unit of claim 9, wherein the number of rollers comprise:

the developer roller to transfer an ink film to a photoconductive imaging plate (PIP) drum;

a squeegee roller to regulate ink film thickness on the developer roller; and a cleaner roller to remove excess ink from the developer roller.

11. The ink developer unit of claim 9, wherein the sealing device is removably coupled to the ink developer unit.

12. The ink developer unit of claim 9, in which the sealing device is used on opposite sides of an ink printing system.

13. An ink developer unit, comprising:

a housing unit;

an end cap removably coupled to the housing unit;

an electrode; and a sealing device disposed within the housing unit, the sealing device comprising:

a rigid plate; and a first compliant sealing member disposed on the rigid plate, the first compliant sealing member comprising a developer roller arm aligned with an interior portion of a side of a developer roller and a cleaner roller arm, wherein the electrode, developer roller arm and cleaner roller arm form a pocket to allow ink to contact the side of the developer roller.

14. The ink developer unit of claim 13, wherein the sealing device further comprises an alignment mechanism to align the sealing device with a number of rollers.

15. The ink developer unit of claim 13, wherein the sealing device contacts a developer roller, a squeegee roller, a cleaner roller, and the end cap.

16. The device of claim 1, wherein the first compliant sealing member and the second compliant sealing member have a same geometry.

17. The device of claim 1, wherein the developer roller arm does not align with a circumference of the side of the developer roller.

18. The device of claim 1, wherein the device is used on either side of a developer roller.

19. The device of claim 4, wherein the mechanism further comprises a number of flexible beams that flex around the tip of the pins and snap into place to secure the sealing device to the ink developer unit.

20. The ink developer unit of claim 9, wherein:

a first compliant sealing member of the number of compliant sealing members is disposed on a first side of the rigid plate and forms a seal between the rigid plate and a number of rollers of the ink developer unit; and a second compliant sealing member of the number of compliant sealing members is disposed on a second side of the rigid plate and forms a seal between the rigid plate and an end cap of the ink developer unit.

* * * * *